United States Patent [19]
Naggar
[11] 4,425,969
[45] Jan. 17, 1984

[54] RAIL-MOUNTED BALLAST REGULATOR MACHINE

[75] Inventor: Rolando Naggar, Rome, Italy
[73] Assignee: Canron Inc., Crissier, Switzerland

[21] Appl. No.: 286,170
[22] Filed: Jul. 23, 1981
[30] Foreign Application Priority Data
Mar. 24, 1981 [CH] Switzerland ..... 2118/81
[51] Int. Cl.³ ..... E01B 27/00
[52] U.S. Cl. ..... 171/16
[58] Field of Search ..... 171/16; 104/2, 4, 7 A, 104/279, 7 R, 7 B

[56] References Cited

U.S. PATENT DOCUMENTS

| | | | |
|---|---|---|---|
| 3,426,379 | 2/1969 | Holley et al. | 171/16 |
| 3,612,184 | 10/1971 | Plasser et al. | 171/16 |
| 4,010,691 | 3/1977 | Theurer et al. | 104/7 A |
| 4,014,389 | 3/1977 | Theurer et al. | 171/16 |
| 4,094,249 | 6/1978 | Theurer et al. | 104/2 |
| 4,203,493 | 5/1980 | Miller | 171/16 |
| 4,257,331 | 3/1981 | Theurer et al. | 171/16 |
| 4,266,615 | 5/1981 | Theurer et al. | 104/2 |

FOREIGN PATENT DOCUMENTS

| | | | |
|---|---|---|---|
| 2733084 | 7/1977 | Fed. Rep. of Germany | 171/16 |

*Primary Examiner*—Gene Mancene
*Assistant Examiner*—John G. Weiss
*Attorney, Agent, or Firm*—Robert E. Burns; Emmanuel J. Lobato; Bruce L. Adams

[57] ABSTRACT

The ballast regulator machine is provided with a ballast plow arrangement, a rotary transverse brush on the rearward end and a ballast transport device with two conveyor belts, the rearward end of the rearward conveyor belt being arranged in the region of the transverse brush and the forward end of the forward conveyor belt being arranged in front of the ballast plow arrangement. The transverse brush is surrounded by a ballast guide housing which is so arranged that the ballast thrown up by the transverse brush is directed into the rearward conveyor belt. The forward conveyor belt can pivot towards both sides about a vertical axis and is extendable towards the front by an adjustable conveyor belt section which in its operating position extends up to a ballast transport wagon arranged in front of the machine and which becomes inoperative in its rest position. In this way the excess ballast picked up by the transverse brush can be distributed either directly in the bed in front of the machine in order to fill in particularly large recesses, or may be loaded onto a transport wagon for reuse at a later date. Beneath the forward end of the front conveyor belt there may also be provided a ballast hopper for intermediate storage from which ballast may be distributed as required on the bed in front of the ballast plow arrangement.

13 Claims, 5 Drawing Figures

RAIL-MOUNTED BALLAST REGULATOR MACHINE

Figure 1:
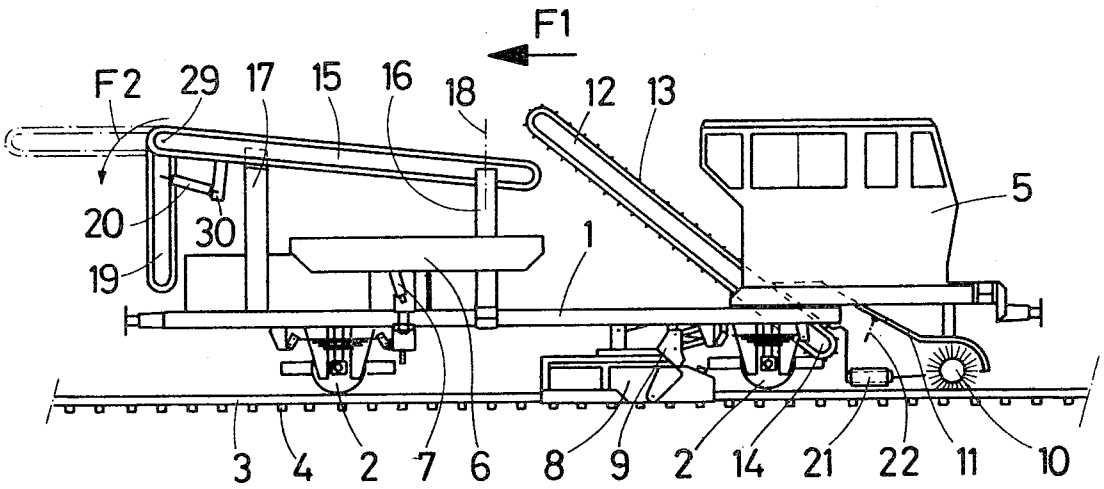

The invention relates to a rail-mounted ballast regulator machine which comprises a ballast plow arrangement and at least one rotating transverse brush installed at the rearward end of the machine for removing the ballast from the sleepers or ties.

Ballast regulator machines are known (German patent application DE-OS No. 1,534,072, Austrian Pat. No. 359,112) and after rail laying, replacement, adjustment, cleaning etc. these serve to distribute and even out the freshly applied ballast while at the same time evenly filling in the spaces between the sleepers and to profiling the shoulders. For this purpose the ballast plow arrangement generally comprises one or two central or front plows and two lateral plows for profiling the shoulders. The transverse brush rotating about a horizontal transverse axis installed at the rearward end of the machine and extending over theentire width of the ballast bed removes the ballast from the sleepers. It is also known to deposit beside the rails through lateral discharge openings the excess ballast picked up or thrown up by the transverse brush or by means of a transverse conveyor belt extending vertically to the rails and installed directly or indirectly in front of the transverse brush.

It happens now that after the aforementioned railwork is completed, for example after the work of a rail laying gang, a rail replacement gang or the operation of a ballast bed cleaning machine, the freshly formed ballast bed at some places has holes or cavities which are so deep that a single pass of the ballast regulator machine cannot completely fill in and level out these holes. Such holes result in particular when the previous machine work, effected continuously or in stages, was temporarily deprived of sufficient fresh or cleaned ballast and as a result the ballast conveyor system, which supplies the fresh ballast to make the bed, momentarily supplies insufficient ballast. Faults in the ballast conveyor system may also be the cause that at some places in the freshly formed bed there is too little ballast so that these cavities are not sufficiently filled in by the subsequent distribution and levelling by the ballast regulator machine.

Therefore, when after levelling by the ballast regulator machine there are still holes or cavities in the ballast bed, it will be necessary to fill these in with ballast in a subsequent special work process and then to level these out again. This is time consuming and increases costs even when using immediately the excess ballast picked up by the transverse brush of the ballast regulator machine for the purpose of filling in the recesses appearing behind the machine, for example by directing backwards onto the ballast bed at least a part of the ballast thrown up by the transverse brush, it would subsequently still be necessary again to level off the places treated with the excess ballast by passing over them with the ballast regulator machine.

It is the object of the invention to provide a ballast regulator machine of the aforementioned type which will also enable the larger holes or cavities, which the known types of machines have previously left unsufficiently filled in, to be filled sufficiently with ballast on being passed over by the machine and which are correctly levelled off without requiring additional work.

This aim is achieved according to the invention in that the ballast regulator machine is provided with a ballast transporting device extending from the area of the transverse brush up to the front of the ballast plow arrangement and the ballast thrown up by the lateral brush falls onto the rearward end of the ballast plow arrangement.

In this way the excess ballast picked up by the transverse brush, which hitherto had to be uselessly deposited beside the track, is made available in front of the ballast plow arrangement in order herewith to sufficiently fill in the holes and cavities appearing in the bed before the ballast plow arrangement, which as a rule comprises central and lateral ballast plows, immediately after distributes and levels the ballast and finally the rotating transverse brush sweeps clean the sleepers.

The arrangement may be such that the ballast conveyed forward by the ballast transport device either falls directly onto the bed in front of the machine, whereby preferably the forward section of the ballast transport device can be pivoted towards both sides, or is caught in a ballast hopper installed beneath the forward end of the ballast transport device from which it can be poured onto the bed on demand. It may also be advantageous to extend forwardly on demand the ballast transport device by means of an extension member which can be extended in the longitudinal direction or which can be pivoted in the direction of travel of the machine to such an extent that the excess ballast can be loaded onto a transport wagon travelling in front of the machine. Alternatively this transport wagon may be provided with a ballast hopper from which on demand the bed can still be filled in. The machine according to the invention can also be provided with a known type of transverse conveyor belt installed directly in front of the transverse brush and with an adjustable deflector device by means of which the ballast picked up by the transverse brush can be directed either onto the said ballast transport device or onto the transverse conveyor belt.

In other words, with simple means the ballast regulator machine according to the invention can use the excess ballast picked up by the rotating transverse brush, either directly for filling-in the ballast bed or at least critical parts of the ballast bed in front of the ballast plow arrangement, or at least store it in a ballast hopper or load it into a transport wagon. In this way it can be ensured that after the passing over by the ballast regulator machine, the ballast bed is levelled and profiled in the regulation manner.

Figure 2:
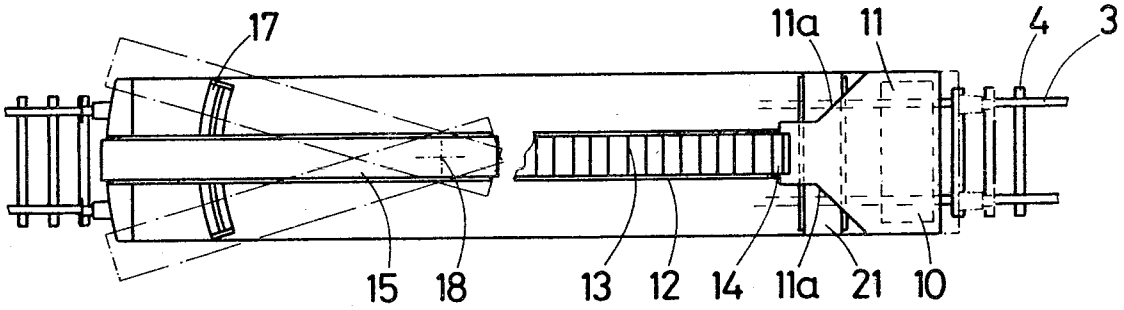
Figure 3:
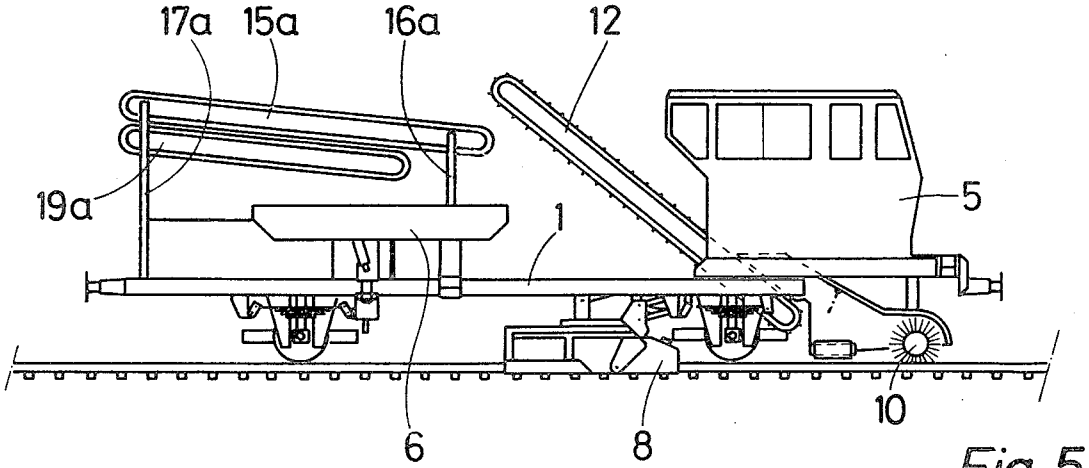
Figure 5:
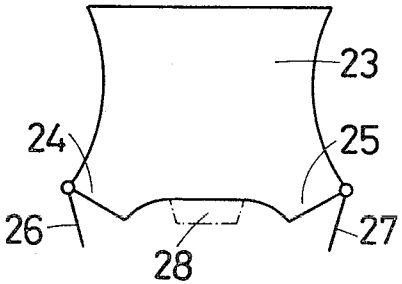
Figure 4:
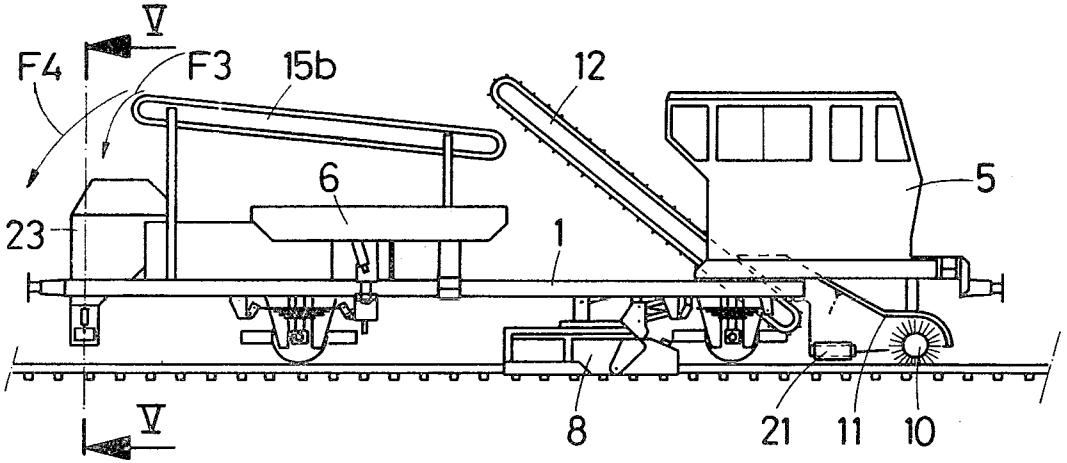

The invention is now explained in more detail with the aid of drawings of embodiment examples. These show:

FIG. 1 a schematic side elevation of a first embodiment of a ballast regulator machine according to the invention;

FIG. 2 a schematic plan view of the machine according to FIG. 1 in which are shown only those parts which are essential for understanding the invention and especially the ballast plows have been omitted;

FIG. 3 a schematic side elevation of a second embodiment;

FIG. 4 a schematic side elevation of a third embodiment with a ballast hopper; and FIG. 5 a schematic section through the hopper along line V—V of FIG. 4.

According to FIG. 1 there is provided a ballast regulator machine having chassis 1, with a drive motor (not shown), which is driven by means of wheels 2 on rails 3 mounted on sleepers 4 and which moves in the operating direction indicated by the arrow F1. The machine also has an operator's cabin 5 and a ballast plow arrangement comprising in the example given of two lateral ballast plows 6 and two central ballast plows 8. The lateral plows 6, which in the said example are arranged in front of the central plows 8 and in FIG. 1 are shown in their upwardly positioned rest position, in a known manner by means of adjusting devices 7 can be pivoted downwards into their work position, horizontally and vertically adjusted and rotated about vertical axis for the purpose of adjusting a specific angle to the direction of travel; they serve essentially for profiling the bed shoulders. The central approximately V-shaped ballast plows 8 are adjustable by means of adjusting means 9 and essentially serve to displace the ballast from the track centre into the lateral regions. Tunnel-like coverings on the rails ensure that no ballast accumulates on the rails and that excess ballast between the rails reaches the lateral regions of the bed over the coverings. The aforementioned parts of the ballast arrangement and their control are generally known and therefore do not have to be described individually; they are therefore only schematically illustrated in the drawings.

On the rearward end of the machine there is provided a transverse brush 10 arranged perpendicularly to the rails 3 which brush according to FIG. 1 is rotated in a clockwise direction by a drive motor (not shown) and can be raised or lowered by a lifting device (also not shown). The transverse brush 10 is encased by a ballast guide housing 11 which is open at the bottom and sweeps clean the sleepers 4 of any excess ballast which is thrown up in the ballast guide housing 11. In order to feed this ballast to the forward end of the machine in front of the ballast plow arrangement, there is provided a ballast transport device having a ballast conveyor belt 12 extending forward diagonally upwards with transverse ribs 13 and in an extension of this belt there is provided a forward ballast conveyor belt 15 which is mounted on supports 16 and 17 above the folded-up lateral plows 6. The rearward end 14 of the ballast conveyor belt 12 is in the region in front of the transverse brush 10 and extends into the ballast guide housing 11 whose side walls 11*a* converge at the front, as shown in FIG. 2, and which is so arranged that the ballast picked up and thrown up by the transverse brush 10 is directed towards the centre onto the rearward conveyor belt end 14.

On the rearward end of the machine chassis 1 directly in front of the transverse brush 10 there are also provided a transverse conveyor belt 21 arranged perpendicularly to the rails 3 and above this in the covering wall of the ballast guide housing 11 there is installed an adjustable deflector plate 22. In the position of the deflector plate 22 shown in broken lines in FIG. 1 the ballast thrown up by the transverse brush 10 is deflected onto the transverse conveyor belt 21 and from here deposited beside the track on one side or the other depending on the direction of travel. In contrast to this, when the deflector plate 22 is pivoted upwards in a clockwise direction according to FIG. 1, the ballast thrown up by the transverse brush 10 passes over the transverse conveyor belt 21 and falls onto the rearward end 14 of the ballast conveyor belt 12.

The forward ballast conveyor belt 15 is rotatably mounted to both sides on its rearward support 16 about the vertical axis 18 so as to adopt the positions on one or the other side as indicated by the broken lines in FIG. 2 and it can slide or roll in the transverse direction on the curved support 17. At the forward end of the ballast conveyor belt 15 there is additionally provided a conveyor belt section 19 pivoting about the horizontal axis 29 and which in its inoperative position (shown in full lines in FIG. 1) hangs downwards in a vertical position and which by means of a hydraulic cylinder 20 can be raised into an essentially horizontal operating position (shown in FIG. 1 in broken lines). In this operating position the ballast transport passage in the direction of travel is extended up to a ballast transport wagon rolling in front of the machine. The hydraulic cylinder 20 on the one hand is connected with the conveyor belt section 19 and on the other hand is connected with a member 30 fixed to the conveyor belt 15.

The ballast regulator machine described, according to FIGS. 1 and 2 offers the following possibilities with regard to the transport and use of the excess ballast picked up by the transverse brush 10.

With the deflector plate 22 is folded upwards and the conveyor belt section 19 is in its inoperative position, the ballast is transported by the ballast conveyor belts 12 and 15 to the forward end of the machine and drops onto the bed in front of the machine as indicated by the curved arrow F2 in FIG. 1. The bed can thus be filled in according to requirement in front of the ballast plow arrangement, i.e. in front of the forward lateral plows 6 shown in the example, and depending upon the particular lateral position of the ballast conveyor belt 15 chosen, the ballast is distributed between the rails 3 or laterally in front of the sleeper heads or on the shoulder of the bed. In this way it is possible to ensure that all recesses and points having too little ballast are properly filled in so that after the passing over by the ballast regulator machine the ballast bed is correctly levelled and all irregularities are straightened out.

When the conveyor belt section 19 takes up its operating position and acts as extension member, the excess ballast is transferred to a transport wagon pushed in front of the machine so that, if required, it can be used again. This ballast transport wagon may be provided with a ballast hopper which if necessary can distribute the ballast on the bed.

Finally, when the deflector plate 22 takes up its position shown by dotted lines in FIG. 1, the ballast is deposited beside the track by the transverse conveyor belt 21.

In the embodiment example according to FIG. 3, in which all the parts corresponding to those of FIG. 1 are provided with the same reference numerals, the forward conveyor belt 15*a* mounted on the supports 16*a* and 17*a* can be extended by an additional conveyor belt 19*a* running parallel to it and which in its inoperative rest position is pulled beneath the ballast conveyor belt 15*a* and in its working position pushed out forward up to a ballast transport wagon. The ballast regulator machine according to FIG. 3 offers the same possibilities as according to FIGS. 1 and 2.

In the embodiment example according to FIG. 4 in which again the parts corresponding to those of FIG. 1 are provided with the same reference numerals, in the front end of the machine chassis 1 beneath the front end of the ballast conveyor belt 15*b* there is installed a ballast hopper 23 which according to FIG. 5 in a transverse direction has two adjacent discharge openings 24 and 25 arranged approximately above the sleeper heads or sleeper ends, these discharge openings 24 and 25 being opened or closed by separately operated or controlled flaps 26 and 27. If necessary, there may also be provided a central opening 28, shown in broken lines in FIG. 5, which also can be opened and closed according to requirement. The ballast conveyor belt 15*b* may be selectively operated with at least two different conveying speeds in such a way that the ballast either is discharged into the ballast hopper 23 for storage (as indicated by arrow F3) when the conveyor belt travels at a sufficiently slow speed, or is thrown over the ballast hopper 23 directly onto the bed such as indicated by the arrow 4. In other words, this embodiment provides the opportunity to distribute the excess ballast picked up by the transverse brush 10 either directly in front of the machine or to store it in the ballast hopper 23 from where it can be distributed on demand through the said discharge openings 24, 25 and if necessary 28 in the region of the sleepers or between the rails. Additionally, the transverse conveyor belt 21 also provides the opportunity of depositing the ballast sideways.

The invention is not limited to the embodiment examples described, but can also be used in many different variations of the ballast transport device and the ballast hopper. Also, in the embodiment example according to FIG. 4 the forward ballast conveyor belt 15*b* can be laterally pivoted on its rearward support about a vertical axis and at its forward end may be provided with an adjustable extension member, as described in the aforementioned examples.

What is claimed is:

1. A rail-mounted ballast regulator machine comprising:

a chassis having wheels running on the rails, ballast plow means mounted on the chassis in position to distribute and profile the ballast of the roadbed, a rotary transverse brush mounted at the rear of the chassis rearwardly of said plow means in position to sweep ballast from the sleepers of the roadbed, and ballast transporting means for receiving ballast thrown up by said rotary brush and transporting it to a location in front of said ballast plow means.

2. Ballast regulator machine according to claim 1, wherein said ballast transporting means extends at least approximately centrally of the chassis and the transverse brush is surrounded by a ballast guide housing the adjacent walls of which converge at the front and direct towards the centre onto the rearward end of the ballast transporting means the ballast thrown up by the transverse brush.

3. Ballast regulator machine according to claim 2, wherein said ballast transporting means comprises a rearwardly extending ballast conveyor belt which at the front extends diagonally upwards and a forward ballast conveyor belt cooperating with said rearwardly extending ballast conveyor belt.

4. Ballast regulator machine according to claim 3, wherein said forward ballast conveyor belt pivots to both sides about a vertical axis extending through its rearward region.

5. Ballast regulator machine according to claim 1, wherein the ballast transporting means in the forward region comprises a moveably mounted extension member which can be adjusted between an inactive rest position in which the ballast can drop onto the roadbed in front of the machine from the forward end of the ballast transporting means, and at least one operating position in which the ballast transporting means is extended forwardly to a ballast transport wagon in front of the machine.

6. Ballast regulator machine according to claim 5, wherein said extension member is a conveyor belt section pivotable about a horizontal axis which section in the inoperative position extends downwardly in an essentially vertical position and in the operative position is arranged in an essentially horizontal position.

7. Ballast regulator machine according to claim 5, wherein said extension member is an additional conveyor belt extending essentially parallel to a forward section of the ballast transporting means which in its inoperative position is drawn back beneath the forward section of the ballast transporting means and in its operative position is pushed out towards the front.

8. Ballast regulator machine according to claim 1, comprising a ballast hopper installed beneath the forward end of said ballast transporting means and adapted to store and to distribute the ballast in the area of the road-bed in front of the ballast plow means, said ballast hopper having at least two discharge openings arranged side by side in a transverse direction and which can be separately opened and closed.

9. Ballast regulator machine according to claim 8, wherein said ballast transporting means is arranged to be driven selectively with at least two different conveying speeds, during the first slow conveying speed the ballast dropping into the said ballast hopper and during the second rapid conveying speed the ballast being thrown over the ballast hopper and onto the roadbeds.

10. Ballast regulator machine according to claim 1, comprising a transverse conveyor belt installed in the area of the transverse brush and extending perpendicularly to the rails, and an adjustable deflecting device which is selectively adjusted in such a way that the ballast being thrown up by the transverse brush essentially reaches said ballast transport device or said transverse conveyor belt for deposition beside the rails.

11. Ballast regulator machine according to claim 1, in which said ballast plow means comprises a V-shaped plow positioned to displace ballast from the track center into lateral regions of the roadbed.

12. Ballast regulator machine according to claim 1, in which said ballast plow means further comprises two lateral plows, for profiling the roadbed shoulders.

13. Ballast regulator machine according to claim 11, further comprising tunnel-like coverings positioned to cover the rails on which the wheels of said chassis run to ensure that no ballast accumulates on the rails.

* * * * *